US005411188A

United States Patent [19]

Teuten

[11] Patent Number: 5,411,188

[45] Date of Patent: May 2, 1995

[54] ADJUSTABLE FRAME BOW MAKING DEVICE

[76] Inventor: Craig S. Teuten, 17 Wapping Rd., Kingston, Mass. 02364

[21] Appl. No.: 213,867

[22] Filed: Mar. 16, 1994

[51] Int. Cl.[6] ..... A41H 43/00

[52] U.S. Cl. ..... 223/46; 223/44

[58] Field of Search ..... 223/44, 46; 28/147, 28/149, 150; 428/4

[56] References Cited

U.S. PATENT DOCUMENTS

| | | | |
|---|---|---|---|
| 2,528,622 | 11/1950 | Teemsma | 223/46 |
| 2,542,222 | 2/1951 | Welch | 223/46 |
| 3,223,440 | 12/1965 | Rosenzweig | 223/46 |
| 3,501,070 | 3/1970 | Shattuck | 223/46 |
| 4,454,968 | 6/1984 | St. Lawrence | 223/46 |
| 4,603,797 | 8/1986 | Gallo, Sr. | 223/46 |
| 4,629,100 | 12/1986 | Owens | 223/46 |
| 5,356,056 | 10/1994 | Teuten | 223/46 |

*Primary Examiner*—Clifford D. Crowder

*Assistant Examiner*—Amy B. Vanatta

*Attorney, Agent, or Firm*—Lahive & Cockfield

[57] ABSTRACT

A device for making decorative ribbon bows comprises an adjustable quadrilateral frame structure formed of four individual elongated planar members which are pivotally attached to one another. First and second elongated planar members form opposite sides of the quadrilateral frame structure, each formed with an elongated slot extending longitudinally through the member. A third elongated planar member contains pivotal connections at opposite ends thereof for pivotally attaching to the elongated slots of the first and second elongated planar members. A fourth elongated planar member contains pivotal connections at opposite ends thereof for attaching to said first and second elongated planar members at points separate from said slots. The third and fourth elongated planar members further include arrays of spaced upstanding rod elements for passage of ribbon material between them.

17 Claims, 4 Drawing Sheets

ADJUSTABLE FRAME BOW MAKING DEVICE

This invention relates to devices and methods for making decorative ribbon bows. More particularly, it relates to a device for making decorative ribbon bows which is adjustable to various sizes and configurations.

BACKGROUND OF THE INVENTION

Decorative bows are typically constructed manually by an operator using various methods of looping, gathering and cinching a length or lengths of ribbon material. Manual construction of decorative bows is a tedious and time-consuming process, particularly in the construction of large quantities of bows, or bows which are either very large or very small, or which have numerous loops of varying size, or which include several different types of ribbon materials. Further, bows which are made by hand are likely to be nonuniform in appearance, flexibility and stability due to variations from bow to bow in such factors as ribbon length, loop size and tension, skill of the operator, operator fatigue, and the like.

Devices for assisting in decorative bow making are known. For example, U.S. Pat. No. 2,542,222 to Welch discloses a device for tying bows which includes a pair of adjustable arms around which ribbon loops may be formed and a center pin which pierces and secures each ribbon loop as it is formed and removed from the arms so that the entire collection of loops may then be secured with a separate tying ribbon. U.S. Pat. No. 4,454,968 to St. Lawrence discloses an apparatus for winding filaments which includes lockable, sliding plates containing upright spindles around which ribbon or other material may be passed, the size of the resulting bow being determined by the distance between the sliding plates when in locked position.

None of the prior art devices is adjustable in both shape and size for making a wide variety of bow shapes and sizes using a single device.

Accordingly, it is an object of this invention to obviate the disadvantages of the prior art.

It is another object of this invention to provide a device for making decorative bows which can be adjusted with respect to both shape and size to permit an operator to construct bows of various shapes, loop sizes and complexity with speed, ease and efficiency.

It is another object of this invention to provide a method of making decorative bows using the device of the invention.

SUMMARY OF THE INVENTION

These and other objects of the invention may be accomplished, according to one aspect of the invention, by an apparatus for making ribbon bows, comprising a quadrilateral frame structure formed of four individual elongated planar members. The first and second of the elongated planar members are positioned to form opposite sides of the quadrilateral frame and have elongated slots in them which extend along their respective longitudinal axes. A first plurality of upstanding rod elements is attached to the third elongated planar member, the rod elements being spaced apart to form a first array extending along the longitudinal axis of the third elongated planar member. Similarly, a second plurality of upstanding rod elements is attached to the fourth elongated planar member, the rod elements being spaced apart to form a second array extending along the longitudinal axis of the fourth elongated planar member. At each end of the third and fourth elongated planar members are pivotal connections for pivotally mounting the third and fourth elongated planar members to the first and second elongated planar members. The pivotal connections at the ends of the third elongated planar member are pivotally mounted in the elongated slots of the first and second planar members for adjustable positioning of the third elongated planar member along the longitudinal axes of the slots. The pivotal connections at the ends of the third elongated planar member may be fastened in any of a plurality of adjustable positions along the slots in the first and second elongated planar members. The pivotal connections at the ends of the fourth elongated planar member are pivotally fixed at one end of each of the first and second elongated planar members.

According to another aspect of the invention, there is provided a method of making decorative ribbon bows, comprising (a) providing an apparatus comprising a quadrilateral frame structure formed of four individual elongated planar members, the first and second of the elongated planar members being positioned to form Opposite sides of the quadrilateral frame, a first plurality of upstanding rod elements being attached to the third elongated planar member and spaced apart to form a first array extending along the longitudinal axis of the third elongated planar member, a second plurality of upstanding rod elements being attached to the fourth elongated planar member and spaced apart to form a second array extending along the longitudinal axis of the fourth elongated planar member, pivotal connections at each end of the third and fourth elongated planar members for pivotally mounting the third and fourth elongated planar members to the first and second elongated planar members, the third elongated planar member having its pivotal connections pivotally mounted for adjustable positioning along the longitudinal axes of the first and second elongated planar members, means for fixing the pivotal connections at the ends of the third elongated planar member in any of a plurality of adjustable positions along the axes, and means for securing ribbon ends to the quadrilateral frame, (b) fixing the elongated planar members in a selected quadrilateral shape, (c) passing a selected length of ribbon material between the arrays of upstanding rod elements in a selected pattern to form a plurality of ribbon loops on the upstanding rod elements, (d) securing the ends of the ribbon material in the means for securing ribbon ends, (e) cinching the ribbon material between the arrays of upstanding rod elements with cinching means to form a decorative ribbon bow, and (f) removing the bow from the apparatus.

In a preferred embodiment the quadrilateral frame structure is arranged in the shape of a trapezoid with the first and second elongated planar members forming parallel edges of the trapezoid. In a second preferred embodiment the quadrilateral frame structure is arranged in the shape of a parallelogram. In a third preferred embodiment the quadrilateral frame structure is arranged in the shape of a rectangle or square. Other quadrilateral shapes and sizes may also be achieved with the apparatus of the present invention.

These and other features of the invention will be more fully appreciated with reference to the following detailed description which is to be read in conjunction with the attached drawings.

DETAILED DESCRIPTION OF THE INVENTION

The invention provides for an apparatus for making ribbon bows comprising a quadrilateral frame structure made of four rigid individual elongated planar members. The first and second of the elongated planar members form opposite sides of the quadrilateral frame structure and contain elongated slots which extend along the longitudinal axes of the respective first and second elongated planar members. The third and fourth elongated planar members each contain a plurality of upstanding rod members spaced apart in an array extending along the longitudinal axes of the respective third and fourth elongated planar members. The ends of the third and fourth elongated planar members contain pivotal connections which permit pivotal engagement of the third and fourth elongated planar members with the first and second elongated planar members. The resulting quadrilateral frame structure is adjustable to form a variety of quadrilateral shapes in a variety of sizes. The fourth elongated planar member is pivotally fixed at each end to a corresponding end of the first and second elongated planar members in an opening which is separate from the slots in the respective first and second elongated planar members. The third elongated planar member may be pivotally fastened at each end to any of a plurality of adjustable positions along the respective slots in the first and second elongated planar members.

Figure 1:
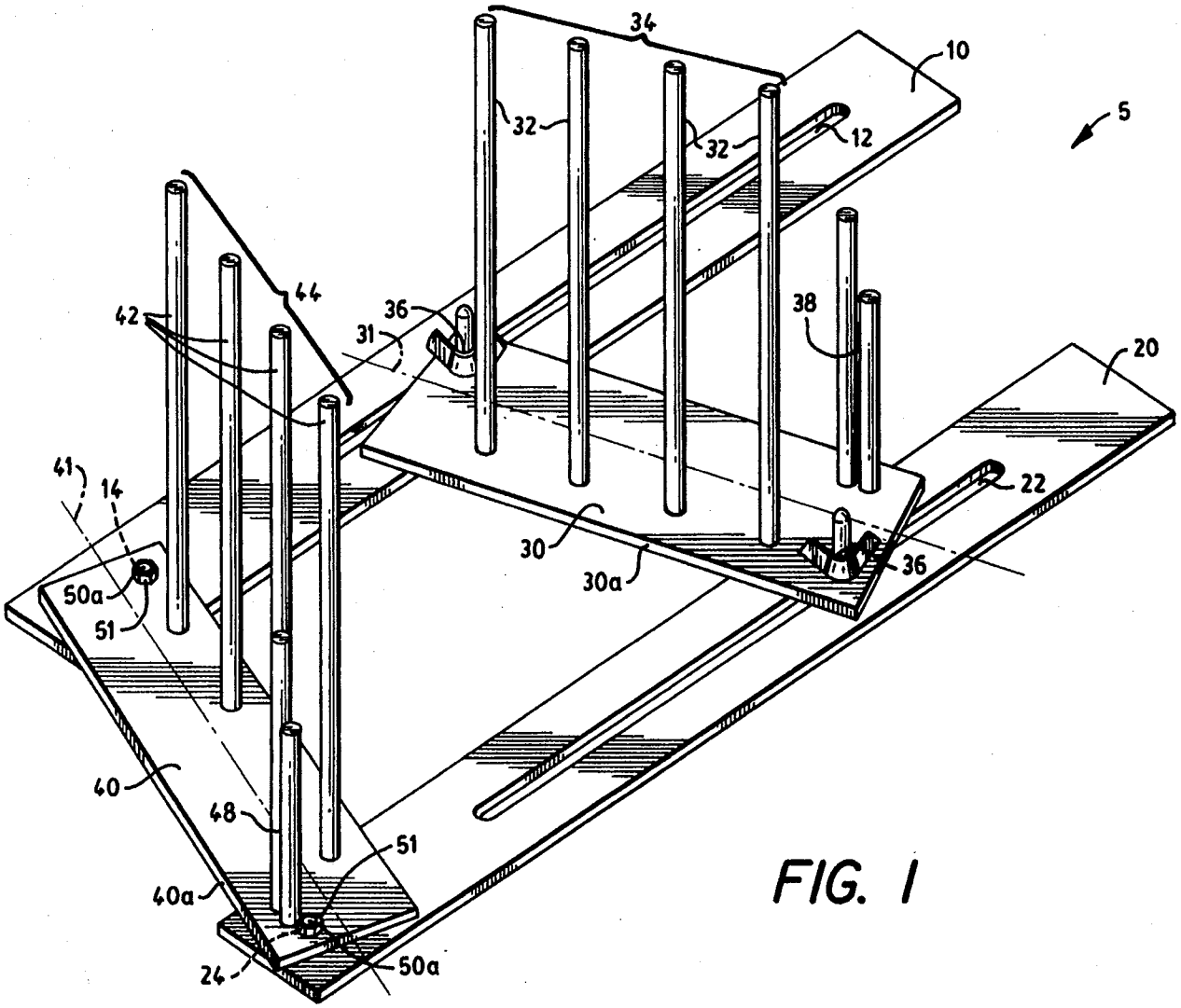
FIG. 1 is a perspective view of an apparatus for making ribbon bows according to a first preferred embodiment of the present invention, in which the quadrilateral frame structure is arranged in the shape of a trapezoid.

Referring more particularly to the drawings, there is shown in FIGS. 1–4 an apparatus 5 for making ribbon bows in accordance with the present invention. As illustrated in FIG. 1, first and second elongated planar members 10, 20 are formed with elongated slots 12, 22 which extend along the longitudinal axes of the respective members 10, 20. These first and second members 10, 20 further contain openings 14, 24 separate from elongated slots 12, 22 for receiving pivotal connection means 50 for pivotally attaching the ends of the fourth elongated planar member 40 to members 10, 20.

The third and fourth elongated planar members 30, 40 each contain a plurality of upstanding rod members 32, 42 spaced apart to form an array 34, 44 along the longitudinal axes 31, 41 of the respective members 30, 40. Third and fourth elongated planar members 30, 40 further each contain a pair of closely spaced rod elements 38, 48 which are positioned between the first and second arrays 34, 44 of rod elements 32, 42 and a first edge **30*a*, 40*a* of the third and fourth elongated planar members 30, 40. The purpose of these pairs is to secure the ribbon ends 72 after weaving of the bow and before the bow is removed from the device. In each pair of closely spaced rod elements, one of the rod elements, preferably the one closest to the operator using the device, is shorter than the other rod element to permit convenient insertion of the loose ribbon ends 72** between the closely spaced rod elements.

The member 30 also contains openings 36 located at each of its ends for receiving the pivotal connections 50 therein to pivotally attach member 30 in the elongated slots 12, 22 in first and second members 10, 20, thereby allowing adjustable positioning of the member 30 in the slots.

As described above, the first and second planar members 10, 20 are pivotally connected to the third and fourth planar members 30, 40 by means of pivotal connection elements 50. Pivotal connection elements 50 each are preferably a bolt such as, for example, a carriage bolt, secured by a nut such as, for example, a lock nut or wing nut. For example, in the connections of the fourth planar member 40 to the first and second members 10, 20 at fixed points, the bolts **50*a* are secured by lock nuts 51** to ensure pivotal movement of the respective elongated planar members about a common point of connection. Other securing means may be employed.

The elongated planar members 10, 20, 30, 40 are preferably rectangular in shape and are preferably formed of a rigid, lightweight material, such as, for example, styrene or polycarbonate. They may be any length and are preferably between 8 and 12 inches long. In a preferred embodiment first and second elongated planar members 10, 20 are about 10 inches long and third and fourth elongated planar members 30, 40 are about 8 inches long. The elongated slots 12, 22 in elongated planar members 10, 20 are preferably about 8 inches long.

The upstanding rod elements 32, 42 and closely spaced rod elements 38, 48 are preferably also made of a rigid, lightweight material and preferably have a limited degree of flexibility in order to permit flexing thereof in response to tension in ribbon 70. The upstanding rod elements 32, 42 are preferably conveniently spaced to permit an operator to pass lengths of ribbon material between the rod elements. A preferred spacing between upstanding rod elements is approximately one inch. The quantity of upstanding rod elements 32, 42 in each array 34, 44 is not critical but is preferably greater than two and will depend in part on the desired size and number of ribbon loops for bows made on the device, as well as the spacing between the rod elements and the length of third and fourth elongated planar members 30, 40. The upstanding rod elements 32, 42 may be of any height which is convenient for use by an operator in holding up to several passes or layers of ribbon lengths around the rod elements. A preferred rod element height is between about 6 and 10 inches. Rod extenders (not shown) may be attached to the ends of the upstanding rod elements 32, 42 to lengthen the rod elements for construction of larger, more complex ribbon bows.

Figure 2:
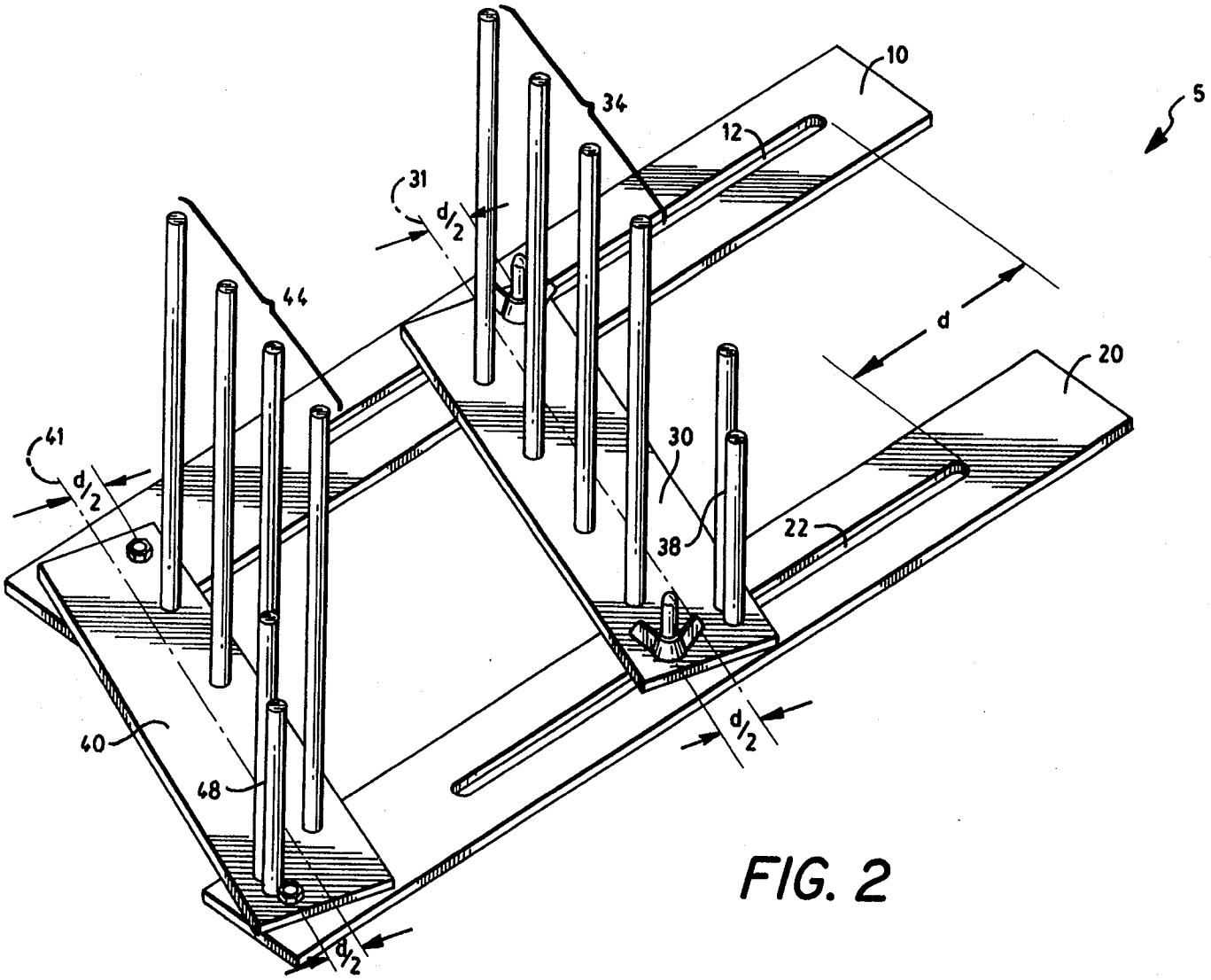
FIG. 2 is a perspective view of a second preferred embodiment of the apparatus for making ribbon bows according to the present invention, in which the quadrilateral frame structure is arranged in the shape of a parallelogram.

In a preferred embodiment, the pivotal connection at one end of third and fourth planar members 30, 40 is displaced or offset from the pivotal connection at the other end of the respective member by distance d in a direction which is normal to the longitudinal axes 31, 41 of the respective members, as shown in FIG. 2. The location of the elongated slot 12 in the first planar member 10 is correspondingly displaced or offset longitudinally from the location of the elongated slot 22 in the second planar member 20 by a distance d equal to the offset distance between the two pivotal connections at opposite ends of third and fourth members 30, 40. The offset distance d is not critical and is preferably about one inch.

Figure 3:
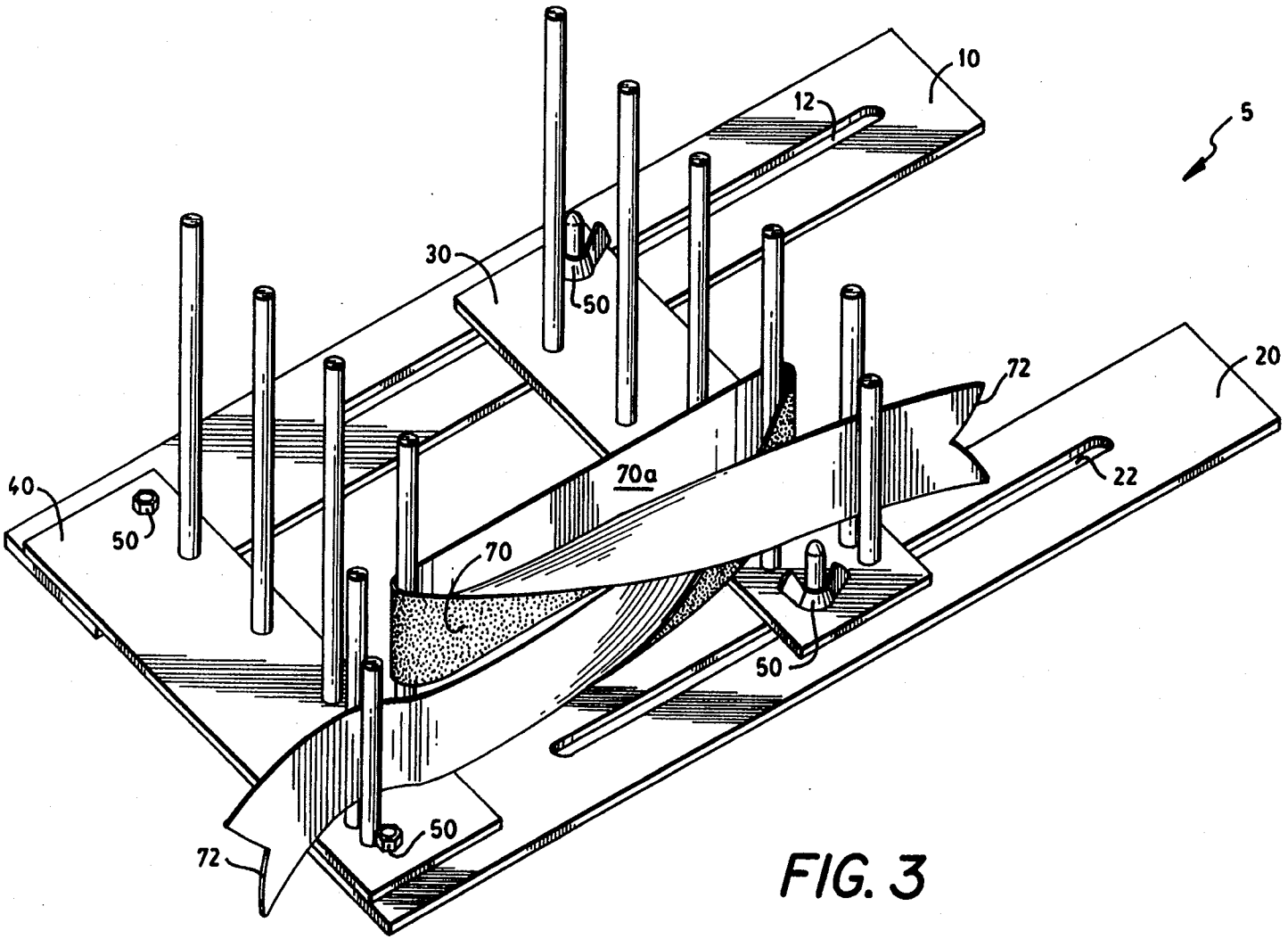
FIG. 3 is a perspective view of a third preferred embodiment of the apparatus for making ribbon bows according to the present invention, in which the quadrilateral frame structure is arranged in the shape of a rectangle and holds a length of ribbon.

In a first preferred embodiment, the quadrilateral frame formed from the connection of the first, second, third and fourth members 10, 20, 30, 40 is configured as a trapezoidal shape, the first and second members 10, 20 forming parallel sides of the trapezoid, as shown in FIG. 1. In a second preferred embodiment, the planar members are connected to form a parallelogram, as shown in FIG. 2. In a third preferred embodiment, the members are connected to form a rectangle, as shown in FIG. 3. The length of the elongated slots 12, 22 in first and second members 10, 20, and the length and width of third and fourth members 30, 40, determines the extent to which the adjustable quadrilateral frame may be adjusted. Each of the above-described frame shapes produces a particular bow shape. For example, the trapezoid produces a pyramidal bow which is wider at its base than at the top. Similarly, the parallelogram shape produces a larger swoop bow.

Figure 4:
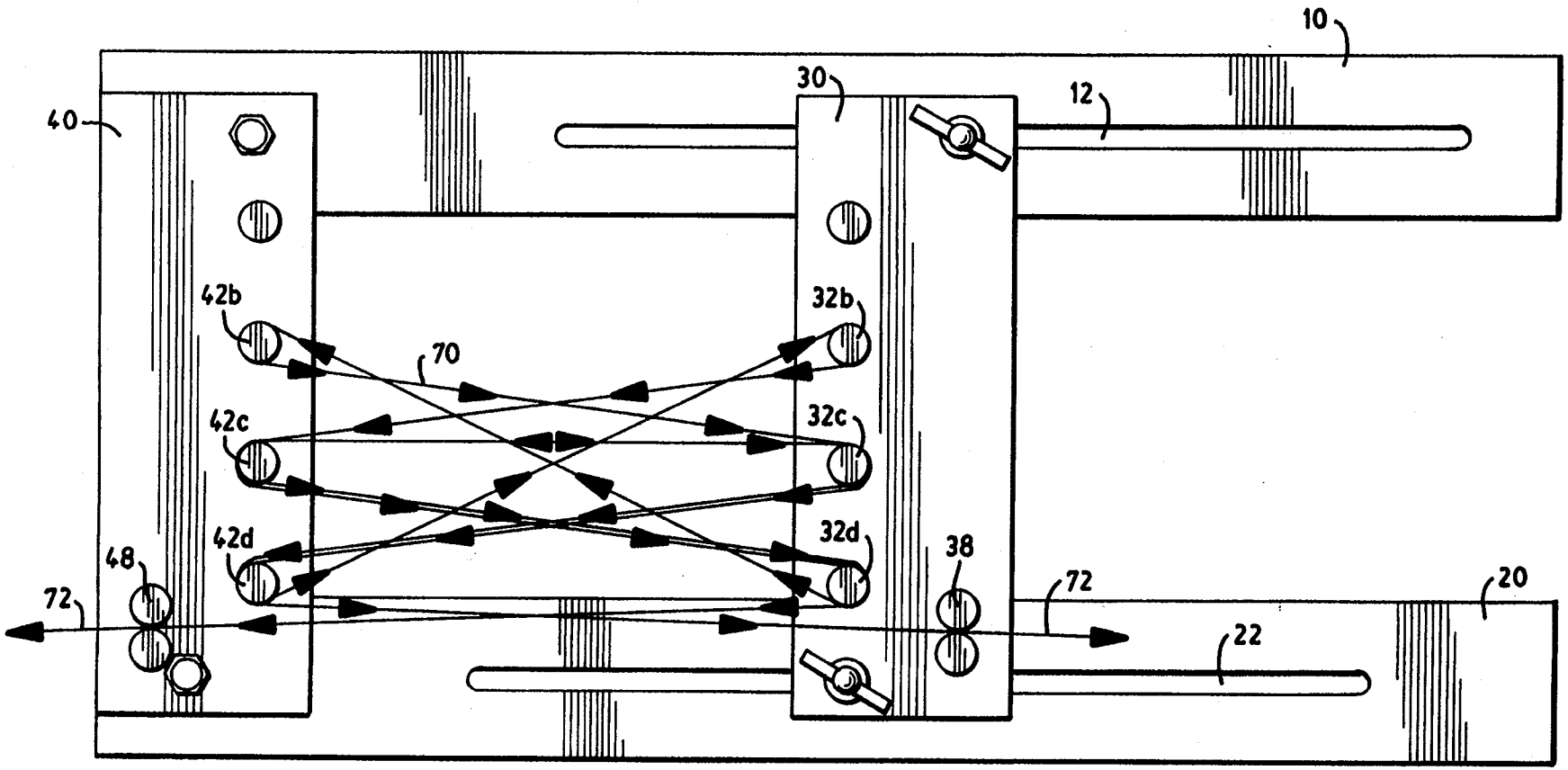
FIG. 4 is a plan view of the apparatus according to the present invention with illustration of a typical weaving pattern.

According to the method of the present invention, a decorative ribbon bow may be made as follows. The shape, size and number of loops of a desired decorative bow are first determined. The apparatus of the present invention is then formed into a desired quadrilateral shape, such as, for example, a trapezoid having parallel edges formed from first and second planar members 10, 20, as shown in FIG. 1. For purposes of illustration, the procedure for constructing an eight-inch diameter pyramid bow having ten loops is described. The quadrilateral frame is first fixed in a trapezoidal shape with the third and fourth planar members 30, 40 spaced apart at their widest point (the base of the trapezoid, typically) by eight inches. Approximately three yards of a desired ribbon material 70 is cut and held by an operator in two hands with an equal amount of ribbon streaming from each hand and a length of ribbon between the hands of no more than twelve inches. As shown in FIG. 4, the ribbon material 70 is looped over upstanding rods **32*b*, 42*b* with the back side 70*a* of the ribbon 70 against the rods, as shown in FIG. 3. With the back side of the ribbon facing the operator, the ribbon 70 is then crossed over itself to create an X. As shown in FIG. 4, with the back side of the ribbon still facing up, the ribbon is now looped over rods 32*c*, 42*c* and again crossed over itself to create an X, always with the back side of the ribbon facing the operator. The ribbon 70 is then looped over rods 32*b*, 42*b*. The ribbon is again crossed with the back side facing the operator and looped over rods 32*d*, 42*d*. The ribbon ends are then drawn toward the operator and crossed once again, with the back side still facing the operator. The ribbon ends 72 are then inserted into closely spaced rod pairs 38, 48** to hold the ribbon in place and prevent unwinding of the bow.

The ribbon material 70 may be a single length of ribbon or may include additional segments of different types of ribbon material. Cinching means (not shown), such as, for example, a wire or elastic band, is applied to the crossed ribbon loops midway between the arrays of rod elements 34, 44 and tightened. The arrays of rod elements are sufficiently flexible to permit some flexing of the upstanding rod elements in response to tension in the ribbon during weaving and cinching of the bow. The resulting decorative ribbon bow is then removed from the apparatus.

Other alterations to the above-described embodiments will be readily apparent to those of ordinary skill in the art and are intended to be embraced within the spirit and scope of the invention. That is, the above description is intended to be illustrative rather than limiting. The invention is to be defined, therefore, not by the preceding description but by the claims that follow.

I claim:

1. Apparatus for making ribbon bows comprising, a quadrilateral frame structure formed of four individual elongated planar members, the first and second of said elongated planar members being positioned to form opposite sides of said quadrilateral frame and being formed with elongated slots therein extending along the longitudinal axes of said first and second elongated planar members, a first plurality of upstanding rod elements attached to the third elongated planar member and spaced apart to form a first array extending along the longitudinal axis of said third elongated planar member, a second plurality of upstanding rod elements attached to said fourth elongated planar member, said rod elements being spaced apart to form a second array extending along the longitudinal axis of said fourth elongated planar member, pivotal connections at each end of said third and fourth elongated planar members for pivotally mounting said third and fourth elongated planar members to said first and second elongated planar members, said third elongated planar member having its pivotal connections pivotally mounted in said elongated slots of said first and second planar members for adjustable positioning along the longitudinal axes of said slots, means for fixing said pivotal connections at the ends of said fourth elongated planar member in a fixed pivoting position at one end of each of said first and second elongated planar members, and means for fixing said pivotal connections at said ends of said third elongated planar member in any of a plurality of adjustable positions along said elongated slots.

2. Apparatus in accordance with claim 1 wherein said means for fixing said pivotal connections at the ends of said fourth elongated planar member are bolts secured by lock nuts and said means for fixing said pivotal connections at the end of said third elongated planar member are bolts secured by wing nuts.

3. Apparatus in accordance with claim 2 wherein said bolts for fixing said pivotal connections at the ends of said third elongated planar member are carriage bolts.

4. Apparatus in accordance with claim 3 wherein said elongated slots are shaped to engage said bolts in nonrotatable position.

5. Apparatus in accordance with claim 1, wherein said elongated planar members are formed of a rigid material.

6. Apparatus in accordance with claim 1 wherein said pivotal connections at the end of said fourth elongated planar member are coupled to said first and second elongated planar members through openings in said first and second elongated planar members which are separate from said slots.

7. Apparatus in accordance with claim 2 wherein said pivotal connections at the end of said fourth elongated planar member are coupled to said first and second elongated planar members through openings in said first and second elongated planar members which are separate from said slots.

8. Apparatus in accordance with claim 1 wherein said pivotal connections on one end of said third and fourth elongated planar members are located at a position displaced from the pivotal connections at the other end of said third and fourth elongated planar members in a direction normal to the longitudinal axes of said third and fourth elongated planar members.

9. Apparatus in accordance with claim 8 wherein the location of said slot in said first elongated member is displaced longitudinally from the location of said slot in said second elongated member by a distance equal to the displacement between the pivotal connections at opposite ends of said third and fourth elongated members.

10. Apparatus in accordance with claim 1 wherein said rod elements have a limited degree of flex.

11. Apparatus in accordance with claim 2 and further including a first additional pair of closely spaced upstanding rod elements positioned between said first array of rod elements and a first edge of said third elongated planar member and a second pair of closely spaced upstanding rod elements positioned between said second array of upstanding rod elements and a corresponding edge of said fourth elongated planar member.

12. Apparatus in accordance with claim 5 wherein said elongated planar members are made of polycarbonate.

13. Apparatus in accordance with claim 5 wherein said elongated planar members are made of styrene.

14. A method of making decorative ribbon bows, comprising (a) providing an apparatus comprising a quadrilateral frame structure formed of four individual elongated planar members, the first and second of said elongated planar members being positioned to form opposite sides of said quadrilateral frame, a first plurality of upstanding rod elements being attached to the third elongated planar member and spaced apart to form a first array extending along the longitudinal axis of said third elongated planar member, a second plurality of upstanding rod elements being attached to said fourth elongated planar member and spaced apart to form a second array extending along the longitudinal axis of said fourth elongated planar member, pivotal connections at each end of said third and fourth elongated planar members for pivotally mounting said third and fourth elongated planar members to said first and second elongated planar members, said third elongated planar member having its pivotal connections pivotally mounted for adjustable positioning along the longitudinal axes of said first and second elongated planar members, means for fixing said pivotal ends of said third elongated planar member in any of a plurality of adjustable positions along said axes, and means for securing ribbon ends to said quadrilateral frame, (b) fixing said elongated planar members in a selected quadrilateral shape, (c) passing a selected length of ribbon material around said upstanding rod elements in a selected pattern to form a plurality of ribbon loops on said upstanding rod elements, (d) securing the ends of said ribbon material in said means for securing ribbon ends, (e) cinching said ribbon loops between said arrays of upstanding rod elements with cinching means to form a decorative ribbon bow, and (f) removing said decorative ribbon bow from said apparatus.

15. A method according to claim 14 wherein said selected quadrilateral shape is a trapezoid, said first and second elongated planar members forming parallel sides of said trapezoid.

16. A method according to claim 14 wherein said selected quadrilateral shape is a parallelogram.

17. A method according to claim 14 wherein said selected quadrilateral shape is a rectangle.

* * * * *